US009520680B2

(12) United States Patent
Hsu et al.

(10) Patent No.: US 9,520,680 B2
(45) Date of Patent: Dec. 13, 2016

(54) ELECTRICAL CONNECTOR WITH TWO GROUNDING BARS

(71) Applicants: Hsiu-Yuan Hsu, New Taipei (TW); Tsu-Yang Wu, New Taipei (TW); Chien-Ping Kao, Hershey, PA (US)

(72) Inventors: Hsiu-Yuan Hsu, New Taipei (TW); Tsu-Yang Wu, New Taipei (TW); Chien-Ping Kao, Hershey, PA (US)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 917 days.

(21) Appl. No.: 13/845,136

(22) Filed: Mar. 18, 2013

(65) Prior Publication Data

US 2014/0004744 A1 Jan. 2, 2014

(30) Foreign Application Priority Data

Jun. 29, 2012 (TW) ..... 101123362 A

(51) Int. Cl.

| | |
|---|---|
| ***H01R 24/00*** | (2011.01) |
| ***H01R 13/658*** | (2011.01) |
| ***H01R 13/6471*** | (2011.01) |
| *H01R 12/72* | (2011.01) |
| *H01R 13/6585* | (2011.01) |

(52) U.S. Cl.

CPC ..... *H01R 13/658* (2013.01); *H01R 13/6471* (2013.01); *H01R 12/722* (2013.01); *H01R 13/6585* (2013.01)

(58) Field of Classification Search

CPC ..... H01R 23/02; H01R 24/60; H01R 24/62

USPC ..... 439/108, 660

See application file for complete search history.

(56) References Cited

U.S. PATENT DOCUMENTS

| | | | | |
|---|---|---|---|---|
| 4,687,267 | A * | 8/1987 | Header | H01R 12/725 439/607.07 |
| 8,142,208 | B2 * | 3/2012 | Ruffner | H01R 13/4534 439/105 |
| 8,262,411 | B2 * | 9/2012 | Kondo | H01R 13/6658 439/607.01 |
| 8,851,927 | B2 * | 10/2014 | Hsu | H01R 13/6594 439/607.11 |
| 9,178,319 | B2 * | 11/2015 | Little | H01R 13/6585 |
| 9,209,573 | B1 * | 12/2015 | Chen | H01R 13/6581 |

FOREIGN PATENT DOCUMENTS

| | | |
|---|---|---|
| CN | 2353064 Y | 12/1999 |
| JP | 4234714 | 6/2007 |
| WO | WO2011090634 A | 7/2011 |

* cited by examiner

*Primary Examiner* — Phuong Dinh

(74) *Attorney, Agent, or Firm* — Wei Te Chung; Ming Chieh Chang

(57) ABSTRACT

An electrical connector includes a housing defining a front and a rear and a first group of contacts. The housing includes a rear base and a front mating tongue defining a first face and a second face opposite to the first face. The first group of contacts is held in the first face of the front mating tongue, the contacts include grounding contacts and signal contacts, each contact includes a retained portion retained in the housing, a contacting portion exposed upon the first face and a connecting leg. The contacting portions of the grounding contacts electrically connect with each other, the retained portions of the grounding contacts electrical connect with each other to reduce electrical length of the electrical connector.

12 Claims, 8 Drawing Sheets

ELECTRICAL CONNECTOR WITH TWO GROUNDING BARS

BACKGROUND OF THE INVENTION

1. Field of the Invention

The present invention generally relates to an electrical connector, and more particularly to an electrical connector capable of high speed and backwards compatibility with relative lower high speed. The invention is related to the co-pending application Ser. No. 13/713,004 filed Dec. 13, 2012.

2. Description of Related Art

Serial Attached SCSI (SAS) is a successor to the parallel SCSI and is also based on serial technology. Besides the advantage of higher speed signal transmission, another most significant advantage is that the SAS interface will also be compatible with SATA drives. In other words, the SATA plug connector can plug directly into a SAS receptacle connector if supported in the system. By this way, the system builders are flexible to integrate either SAS or SATA devices and slash the costs associated with supporting two separate interfaces.

U.S. Pat. No. 6,942,524 discloses a SAS connector for SAS 2.0 standard transmitting 6.0 Gbps. Higher signal transmission is a tendency in high speed industry. Connectors adapted for speed higher than 6.0 Gbps is developing. Questions of electrical performance, such as cross talk, signal attenuation arises. Particularly, crosstalk is a major issue at 12 Gbps. So, we hope design an electrical connector to overcome said question.

SUMMARY OF THE INVENTION

Accordingly, an object of the present invention is to provide electrical connectors capable to more than 12 Gbps.

In order to achieve the object set forth, an electrical connector comprises a housing defining a front and a rear and a first group of contacts. The housing comprises a rear base and a front mating tongue, the front mating tongue defines a first face and a second face opposite to the first face. The first group of contacts is held in the first face of the front mating tongue, the contacts comprise grounding contacts and signal contacts, each contact comprises a retained portion retained in the housing, a contacting portion exposed upon the first face of the front mating tongue and a connecting leg. The contacting portions of the grounding contacts electrically connect with each other, the retained portions of the grounding contacts electrical connect with each other to reduce electrical length of the electrical connector.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
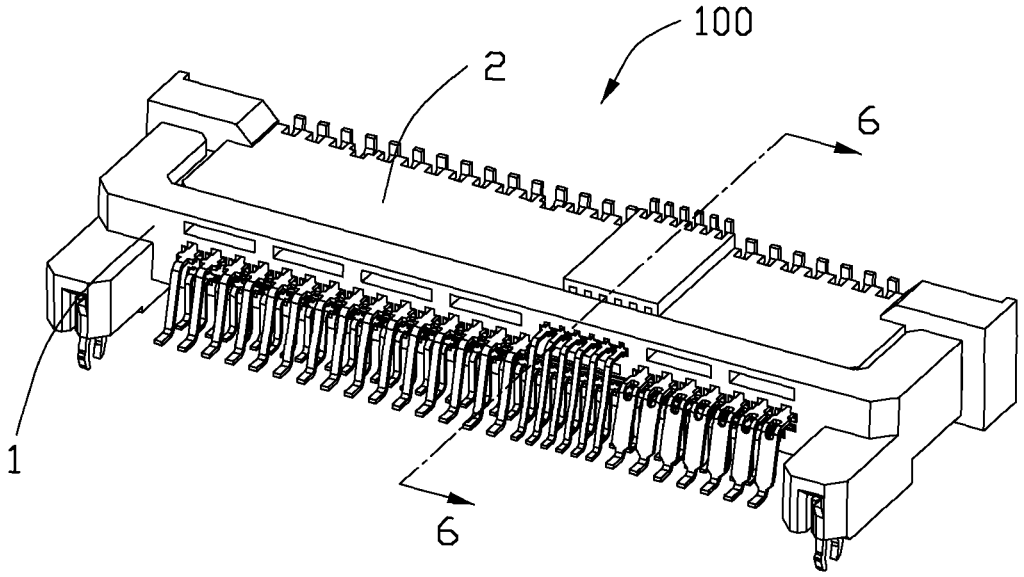
FIG. 1 is a mated perspective view of an electrical connector assembly of a first embodiment in accordance with the present invention.
Figure 2:
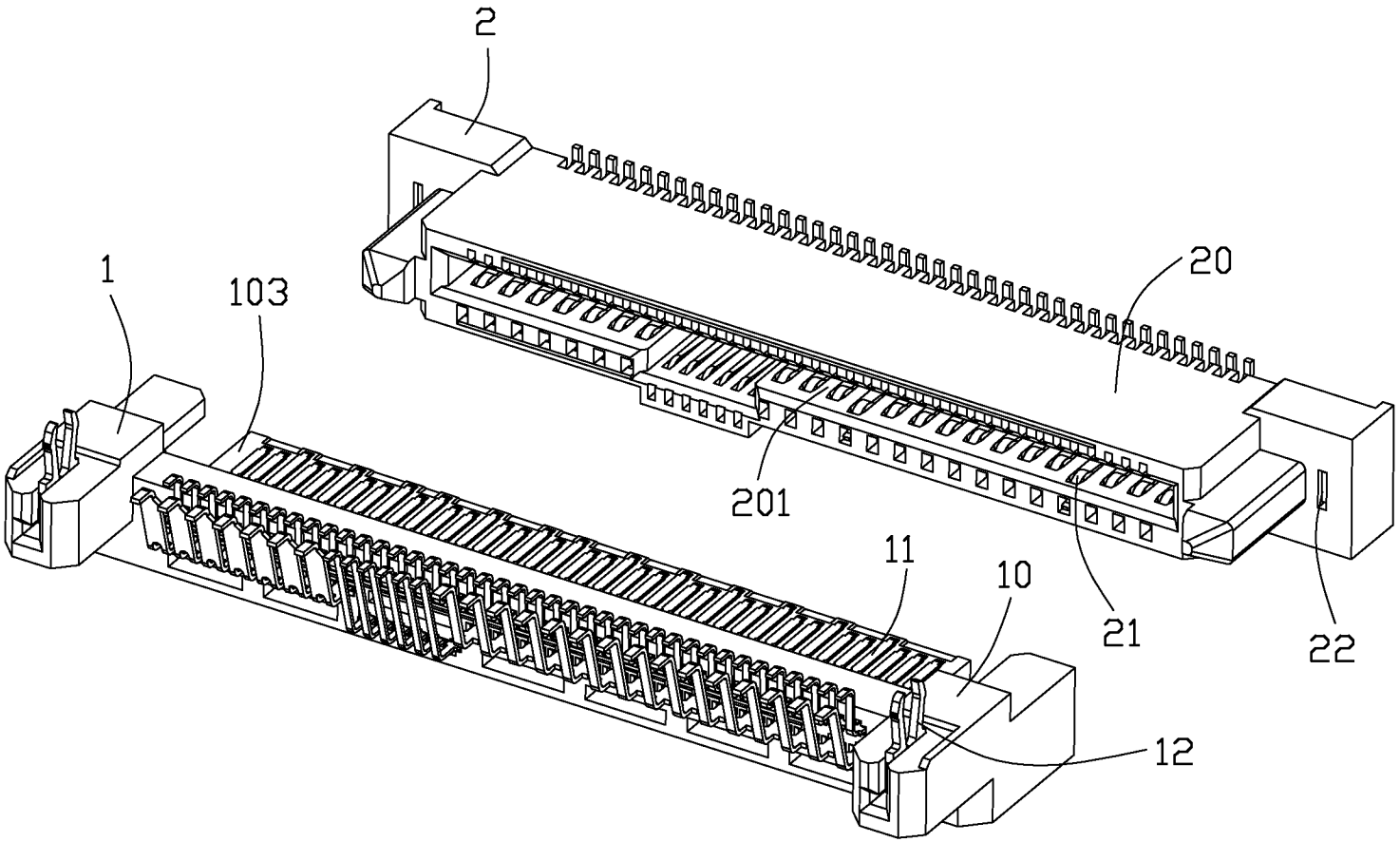
FIG. 2 is a perspective view of the electrical connector assembly shown in FIG. 1, wherein two connectors disconnect from each other.

Referring to FIGS. 1 and 2, an electrical connector assembly 100 is provided an interface for a high speed storage device, especially for SAS signal transmission which is capable of operation up to 24 Gps. The assembly 100 includes a first/plug connector 1 and a second/receptacle connector 2. The second connector 2 is backwards compatible with current standard SAS and Serial ATA plug connector.

Figure 3:
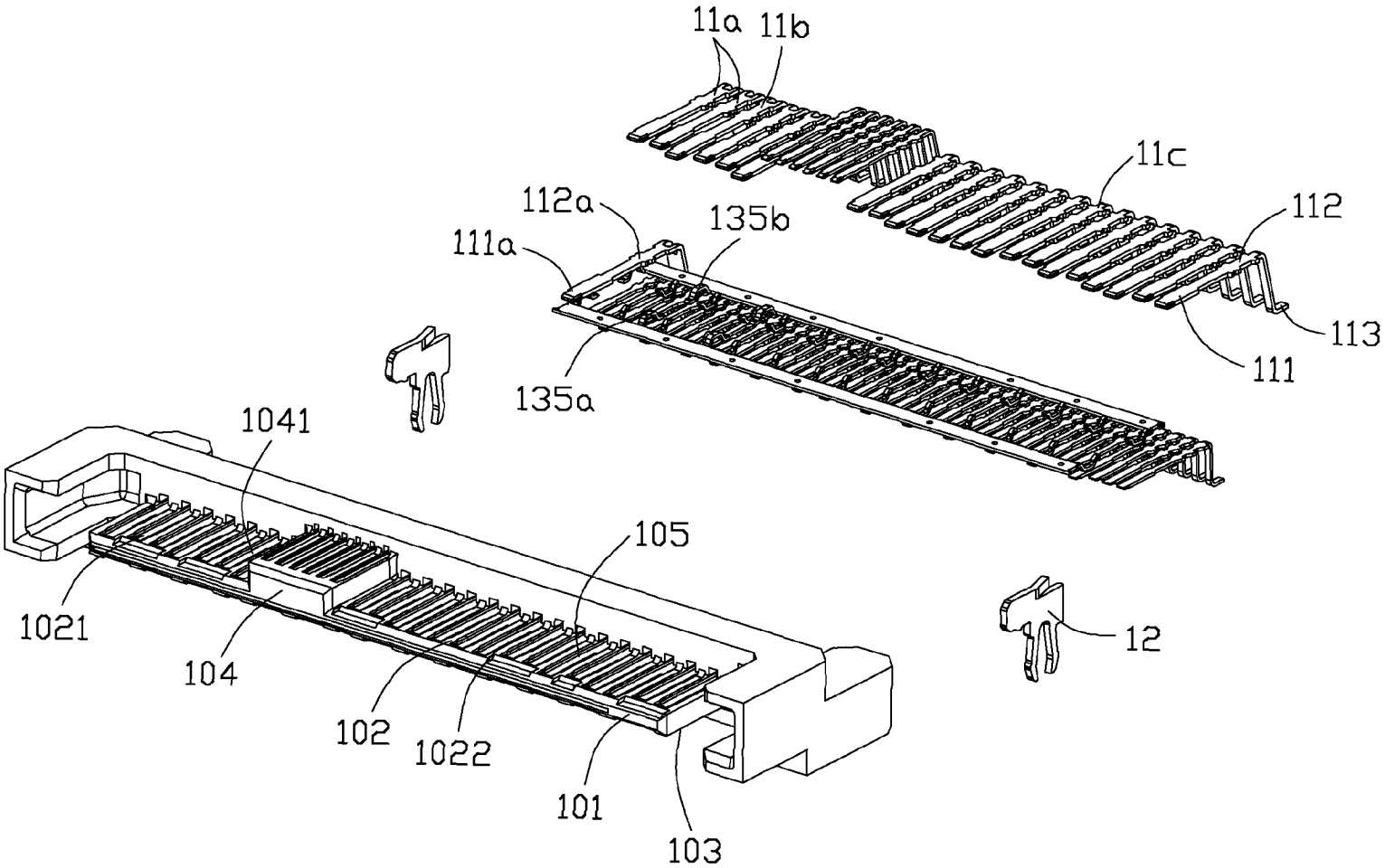
FIG. 3 is an exploded perspective view of a plug electrical connector shown in FIG. 1.

Referring to FIGS. 2 and 3, the first connector 1 includes a housing 10 made from insulating material, a plurality of conductive terminals 11 held in the housing 10 and a pair of board-lock members 12 for retaining the first connector on a printed circuit board. The housing 10 of a longitudinal shape includes a front mating tongue 101 extending forwards from a longitudinal rear base. The mating tongue 101 defines a first face 102 and a second face 103 opposite to the first face 102. The mating tongue 101 defines a keying rib 104 at the first face 12, which divides the first face to a first section 1021 and a second section 1022. Therefore, the first face 102 is provided with a first mating face therealong and a third mating face 1041 higher than the first face 102 at the keying rib 104, the second face 103 is provided with a second mating face. The housing defines a plurality of terminal grooves 105 exposed upon said three mating faces. The terminals 11 retained in the housing, comprise contacting portions 111 accommodating in the terminal grooves 105 and exposed upon said three mating faces, retained portions 112 with bars retained with the housing and connecting legs 113 located along a rear end of the housing 10. The contacting portions 111 and connecting legs 113 extend from the retained portions oppositely, and the contacting portions and the retained portions are in a same planar.

Figure 4:
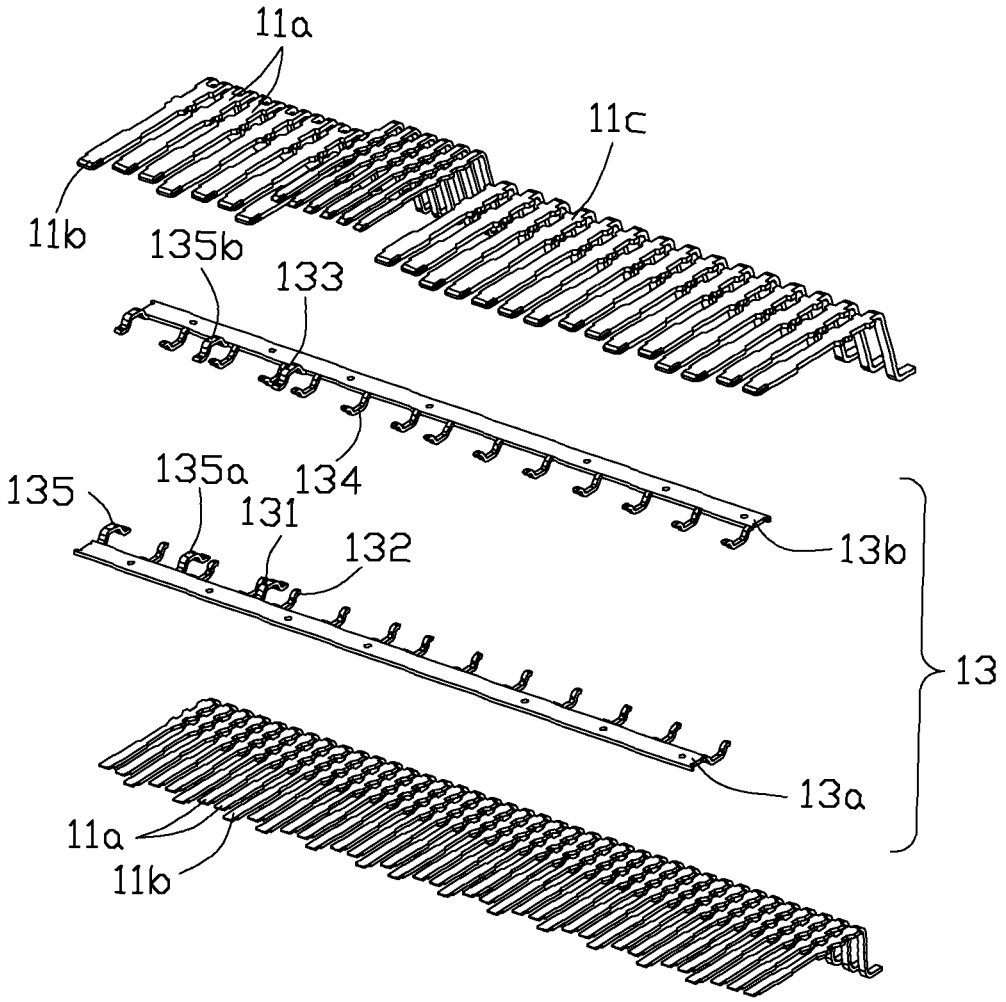
FIG. 4 is a perspective view of terminals and two grounding bars of the plug connector.

Referring to FIG. 4, the terminals 11 of the first connector 1 in this embodiment includes a first group of terminals located at the first face 102 and a second group of terminals at the second mating face 103. The first group of terminals is further divided to three sub-groups of terminals on the first portion 1021 of the first face 102, the third mating face 1041 and the second portion 1022 of the first face 102 of the mating tongue 101, respectively. The sub-group of terminals on the second portion 1022 is served as power terminals 11*c*, other sub-groups of terminals are served as signal terminals. Those signal terminals includes grounding terminals 11*b* and pairs of differential pair 11*a* consisting of two adjacent terminals to transmit signal. The differential pairs and the grounding terminals are alternatively arranged. The contacting portions of the power terminals 11*c* are exposed upon the second portions 1022 of the first face 102. The contacting portions of the differential pairs 11*a* and the grounding terminals 11*b* of the first group are exposed upon the second and third mating faces 103, 1041. The contacting portions of the second group of terminals are exposed upon the second face 103. The grounding terminals 11*b* are located at opposite sides of the differential pair 11*a* to reduce cross talk between differential pairs.

Figure 6:
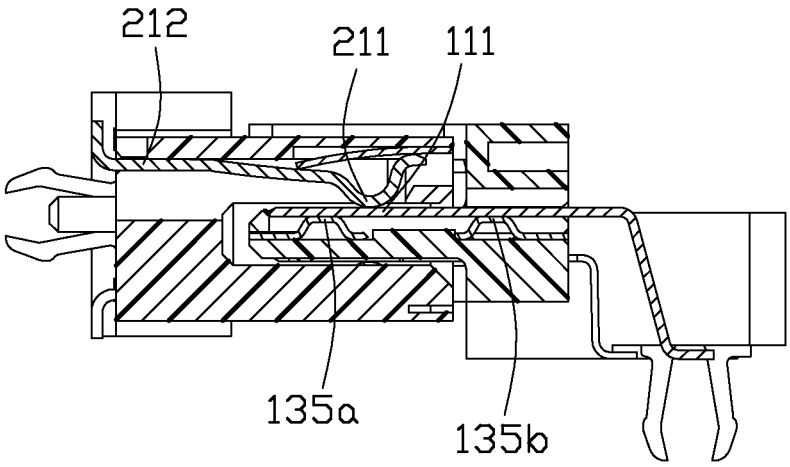
FIG. 6 is a cross-sectional view of the electrical connector assembly taken from lines 6-6 in FIG. 1.

The first connector 1 includes at least one grounding bar 13*a*/13*b*, the grounding bar is embedded in the mating tongue 101 and is interposed between the first and the second faces 102, 103. In this embodiment, the first connector 1 includes two grounding bar 13*a*, 13*b* with similar structure, which are symmetrically located at a front and rear end of the mating tongue 101. A plurality of first fingers 131 and second fingers 132 extend rearward from the first grounding bar 13*a*, the first fingers 131 curve upwards and the second fingers curve downward, i.e, slant towards the first face and towards the second face respectively as shown in FIG. 3. The second grounding bar 13*b* also rearwards extends a plurality of first fingers 133 and second fingers 134, which slant upwards and downwards respectively. Said fingers of the first and second grounding bars have contacting sections 135*a*, 135*b* respectively. The first fingers 131 of the first grounding bar 13*a* touch or electrical and mechanically contact with the contacting portions 111*a* of the grounding terminals 11*b* of the first group of terminals. The first fingers 134 of the second grounding bar 13*b* touch or electrical and mechanically contact with the retained portions 112*a* of the grounding terminals 11*b* of the first group of terminals. The second fingers 132 of the first grounding 13*a* touch or electrical and mechanically contact with the contacting portions of the grounding terminals of the second group of terminals. The second fingers 133 of the second grounding bar 13*b* touch or electrical and mechanically contact with the retained portions 112 of the grounding terminals of the second group of terminals. Alternatively, the first and second grounding bars can be formed unitarily. As best shown in FIG. 6, each grounding terminal 11*b* connects with the grounding bars at two positions, that is to say, the contacting portion and the retained portion of each grounding terminal connects with two grounding bars.

Figure 5:
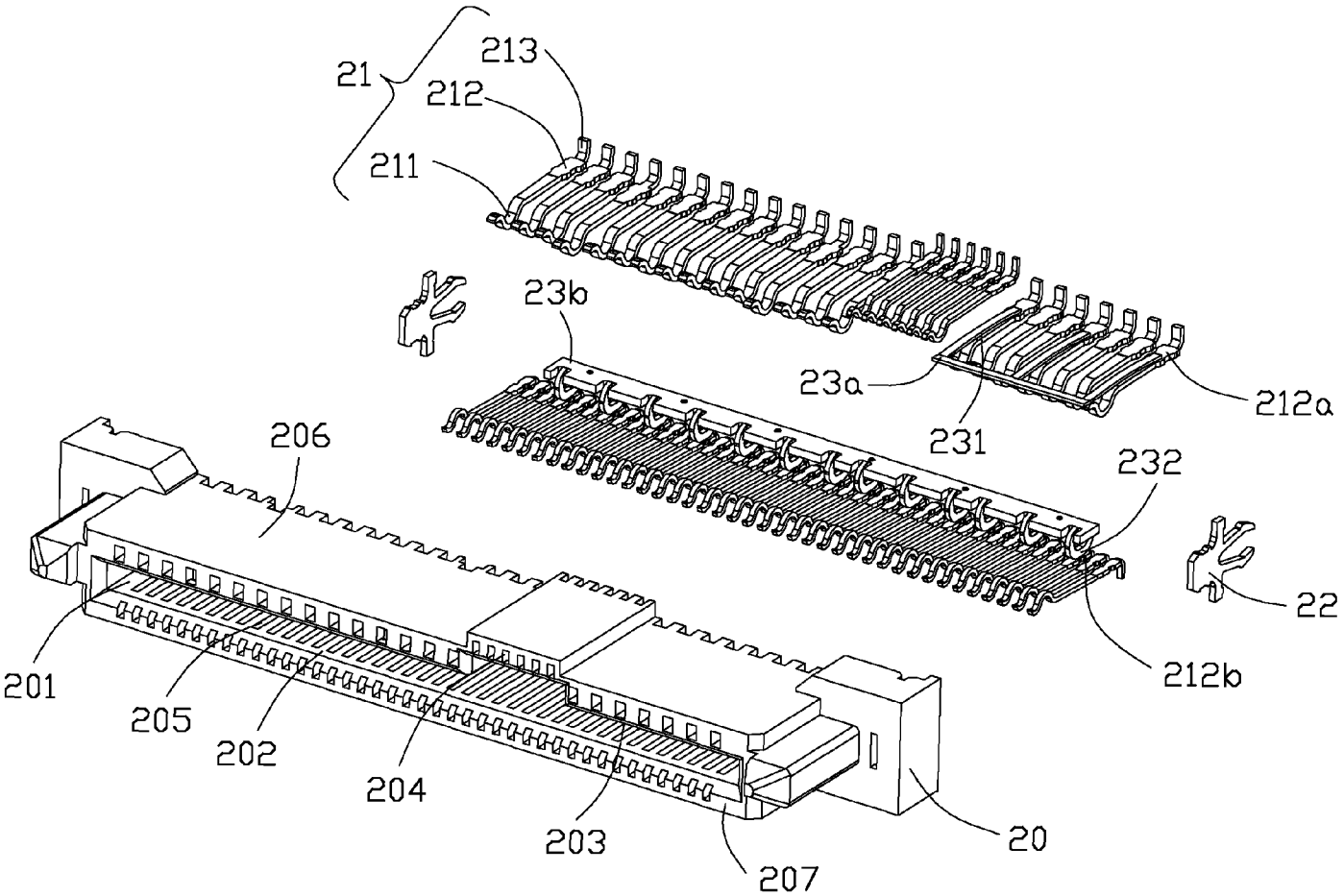
FIG. 5 is an exploded perspective view of a receptacle electrical connector shown in FIG. 2.

Referring to FIG. 5 with FIG. 2, the second connector 2 includes a hosing 20, a plurality of conductive terminals 21 in the housing and board-locking members 22 to retain the connector on a printed circuit board. The housing of the second connector of a longitudinal shape defines a front-opening mating slot 201. The mating slot defines a first inside 203, a second inside 202 and a third inside 204, the first inside 203 is located between the first and third inside. Said three insides are disposed corresponding to the first mating face through the second mating face of the first connector. A plurality of terminal grooves 205 is disposed upon said three insides. The terminals 21 comprise elastic contacting portion 211 exposed to the mating slot 201, retained portions 212 retained in the housing and connecting legs 213.

The terminals 21 of the second connector 2 are arranged corresponding to the terminals 11 of the first connector 1. The second connector 2 further comprises a first grounding bar 23*a* and a second grounding bar 23*b* retained on an upper and a lower sidewalls 206, 207 respectively. The first grounding bar 23*a* defines three linear fingers 231 extending rearwards therefrom, which touch the retained portions 212*a* of three grounding terminals on the upper sidewall 206. The second grounding bar 23*b* defines arc fingers 232 curved downwards, which touch the retained portions 212*b* of the grounding terminals on the lower sidewall 207. Best shown in FIG. 6, the first grounding bar 23*a* is retained in a front portion of the upper sidewall 206 and the second grounding bar is retained on a rear base from which said two sidewalls 206, 207 extend.

Figure 7:
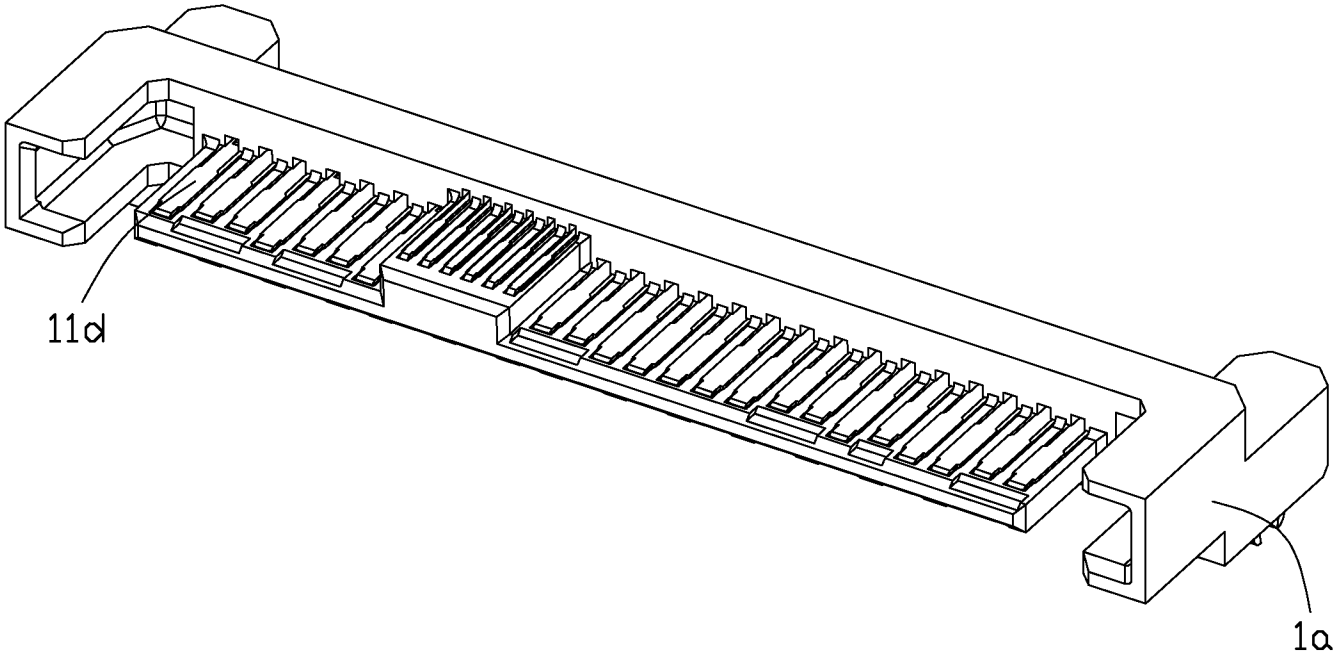
FIG. 7 is a perspective view of a plug connector of a second embodiment in accordance with the present invention.
Figure 8:
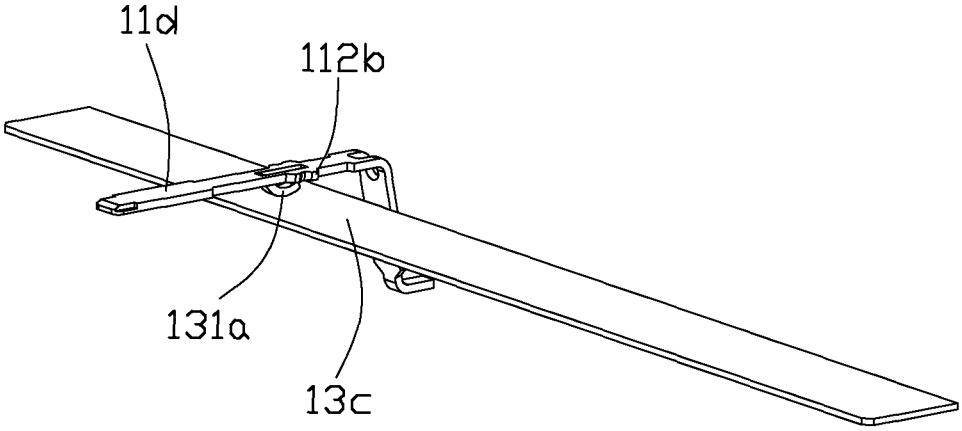
FIG. 8 is a perspective view of a terminal and a grounding bar of the plug connector of FIG. 7.

When the first and second connectors 1, 2 mate with each other, the mating tongue 101 is inserted in the mating slot 201 and the contacting portions 111 of the first connector 1 electrically and mechanically connect with the contacting portion 211 of the second connector 2. The grounding bars integrally connect with all ground contacts in one group. The grounding bars make electrical contact with the grounding terminals, an electrical circuit is created through the grounding bars and through the grounding terminals engaged by the grounding bars, which is shorter than the grounding patch defined only along the grounding terminals without the grounding bars. The length of the electrical circuit corresponds with a predetermined resonance frequency than higher than the resonance frequency of the grounding terminals without the grounding bars, which is meet performance of high speed electrical connector. Ground potential difference between the contacting portion and the retained portion of each grounding terminals is eliminated as possibly FIGS. 7 and 8 show another embodiment of this present invention, an arc finger 131*a* split from a retained portion 112*b* of the grounding terminals 11*d*. The arc finger 131*a* presses against the grounding bar 13*c* so as to electrically and mechanically connect with the first grounding bar 13*c*.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

We claim:

1. An electrical connector comprising:

a housing defining a front and a rear, the housing comprising a rear base and a front mating tongue, the front mating tongue defining a first face and a second face opposite to the first face;

a first group of terminals held in first face of the front mating tongue, the first group of terminals comprising grounding contacts and signal terminals, each terminal comprising a retained portion retained in the housing, a contacting portion exposed upon the first face of the front mating tongue and a connecting leg;

wherein the contacting portions of the grounding terminals electrically connecting with each other, the retained portions of the grounding terminals electrical connecting with each other to reduce electrical length of the electrical connector, wherein comprising a one-piece second grounding bar retained in the front mating tongue, the second grounding bar being electrically and mechanically connected with the contacting portions of the grounding contacts, wherein a second group of terminals retained in the second face of housing, each terminal comprising a retained portion, a contacting portion exposed upon the second face of the front mating portion and a connecting leg; the second group of contacts comprising grounding contacts and signal contacts; said first and second grounding bar defining a plurality of fingers touching with the retained portions and contacting portions of the first and second groups of terminals correspondingly.

2. The electrical connector as claimed in claim 1, comprising a one-piece first grounding bar retained in the housing, the first grounding bar being electrically and mechanically connected with the retained portions of the grounding contacts.

3. The electrical connector as claimed in claim 2, wherein the first grounding bar is inserted in the rear base of the housing.

4. The electrical connector as claimed in claim 1, wherein the fingers are in a U shaped with a horizontal portion, the horizontal portions touching with the retained portions and contacting portions of the first and second group of contacts correspondingly.

5. The electrical connector as claimed in claim 1, comprising a second group of terminals retained in the second face of housing, each terminal comprising a retained portion, a contacting portion exposed upon the second face of the front mating portion and a connecting leg;

the second group of contacts comprising grounding contacts and signal contacts;

a plurality of fingers punched from the retained portions of the grounding terminals and touch the second grounding bar.

6. An electrical connector comprising:

an insulative housing;

a plurality of first contacts disposed in the housing and categorized with grounding and signal contacts alternately arranged with each other in a first row, each of said first contacts defining a front contacting section and a rear retaining section;

a front grounding bar assembled to the housing and associated with a plurality of front fingers mechanically and electrically connecting to the front contacting sections of the selected grounding contacts; and a rear grounding bar assemble to the housing and associated with a plurality of rear fingers mechanically and electrically connecting to the rear retaining sections of said selected grounding contacts, wherein the housing defines a mating tongue, and outer faces of the front contacting sections are exposed upon one face of the mating tongue while the first grounding bar is located within the mating tongue with said fingers respectively abutting against inner faces of the corresponding contacting sections of the selected grounding contact, wherein said front fingers are unitarily formed with the front grounding bar, and said rear fingers are unitarily formed with the rear grounding bar, wherein further including a plurality of second contacts categorized with ground and signal contacts alternately arranged with each other in a second row, each of said second contacts defining a front contacting section and a rear retaining section, wherein additional front fingers are provided to mechanically and electrically connect the front grounding bar and the front contacting sections of selected grounding contacts of the second contacts, and additional rear fingers are provided to mechanically and electrically connect the rear grounding bar and the rear retaining sections of said selected grounding contacts of the second contacts.

7. The electrical connector as claimed in claim 6, wherein said additional front fingers are unitarily formed with the front grounding bar, and said additional rear fingers are unitarily formed with the rear grounding bar.

8. The electrical connector as claimed in claim 6, wherein outer faces of the front contacting sections of the second contacts are exposed upon the other face of the mating tongue, and the additional front fingers respectively abut against inner faces of the corresponding front contacting sections of the selected grounding contacts of the second contacts.

9. The electrical connector as claimed in claim 6, wherein the front grounding bar is rearward assembled into a mating tongue of the housing while the rear grounding bar is forwardly assembled into a rear side of the housing.

10. An electrical connector assembly comprising:

a first connector including a first insulative housing defining a mating tongue;

a plurality of first contacts disposed in the housing and categorized with grounding and signal contacts thereof, each other contacts defining a front contacting section and a rear retaining section, an outer face of the front contacting section being exposed upon the mating tongue;

a first grounding bar embedded in the mating tongue and associated with a plurality of front fingers abutting against inner faces of the contacting sections of the selected grounding contacts of the first contacts;

a second connector mated with the first connector and including a second insulative housing defining receiving cavity to receive said mating tongue;

a plurality of second contacts disposed in the second housing and categorized with grounding and signal contacts thereof, each of said second contacts defining a front contacting section and a rear retaining section, the front contacting sections of said second contacts resiliently extending into the receiving cavity to resiliently contact the outer face of the contacting section of the corresponding second contact; and a second grounding bar assembled to the second housing and associated with a plurality of front fingers to mechanically and electrically connect the front contacting sections of the selected grounding contacts of the second contacts; wherein the selected grounding contacts of the first contacts are mated with the selected grounding contacts of the second contacts, respectively, wherein said front fingers of the first grounding bar are unitarily formed with the first grounding bar, and said front fingers of the second grounding bar are unitarily formed with the second grounding bar.

11. The electrical connector assembly as claimed in claim 10, wherein a contacting point between the front contacting section of the first contact and the front contacting section of the corresponding second contact is closer to a root region of the mating tongue than another contacting section between the front spring of the first grounding bar and the front contacting section of the selected grounding contact of the first contact.

12. The electrical connector assembly as claimed in claim 10, wherein a contacting point between the front contacting section of the first contact and the front contacting section of the corresponding second contact is closer to a root region of the mating tongue than another contacting section between the front spring of the second grounding bar and the front contacting section of the selected grounding contact of the second contact.

* * * * *